US006754915B2

(12) United States Patent
Mistarz

(10) Patent No.: US 6,754,915 B2
(45) Date of Patent: Jun. 29, 2004

(54) SCUPPER WITH AUTOMATIC SHUTOFF VALVE

(76) Inventor: Richard Mistarz, 616 Weston Pointe Ct., Longboat Key, FL (US) 34228

( * ) Notice: Subject to any disclaimer, the term of this patent is extended or adjusted under 35 U.S.C. 154(b) by 30 days.

(21) Appl. No.: 10/261,712

(22) Filed: Oct. 1, 2002

(65) Prior Publication Data

US 2004/0060106 A1 Apr. 1, 2004

(51) Int. Cl.[7] ..... E04H 4/00
(52) U.S. Cl. ..... 4/507; 4/508; 4/509
(58) Field of Search ..... 4/507, 508, 509; 37/433, 855, 257, 227.8, 448; 73/322.5

(56) References Cited

U.S. PATENT DOCUMENTS

| | | | | | |
|---|---|---|---|---|---|
| 999,619 | A | | 8/1911 | Young | |
| 1,366,028 | A | * | 1/1921 | Schlag | 137/433 |
| 1,538,656 | A | | 5/1925 | Richardson | |
| 1,897,492 | A | * | 2/1933 | Ledoux | 137/433 |
| 2,476,434 | A | * | 7/1949 | Spang | 137/433 |
| 2,871,875 | A | * | 2/1959 | Dale | 137/433 |
| 3,067,879 | A | * | 12/1962 | Baker | 210/129 |
| 3,626,521 | A | * | 12/1971 | Delco | 137/448 |
| 3,895,402 | A | * | 7/1975 | Page | 4/508 |
| 4,240,167 | A | | 12/1980 | Gilliland | |
| 4,687,023 | A | | 8/1987 | Harbison et al. | |
| 4,700,741 | A | | 10/1987 | Murphy | |
| 4,905,726 | A | * | 3/1990 | Kasugai et al. | 137/433 |
| 5,406,972 | A | * | 4/1995 | Coscarella et al. | 137/315.08 |

* cited by examiner

*Primary Examiner*—Henry Bennett
*Assistant Examiner*—Azy Kokabi

(57) ABSTRACT

An automatic shutoff valve that can be easily installed in a swimming pool skimmer, that will prevent the flow of air through the suction outlet when the water level drops below the minimum level required to maintain buoyancy of the automatic shutoff valve's float. The valve is designed to automatically reset to normal when a sufficient level of liquid is restored in the pool and skimmer assembly, and any suction acting on the outflow portion of the valve is briefly interrupted to release the float from its position on the valve seat. During operation, the valve protects the pool's circulating pump from damage that could result from becoming air-bound ad losing its prime, as a result of sucking air through the skimmer's bottom outlet.

8 Claims, 6 Drawing Sheets

FIG. 1
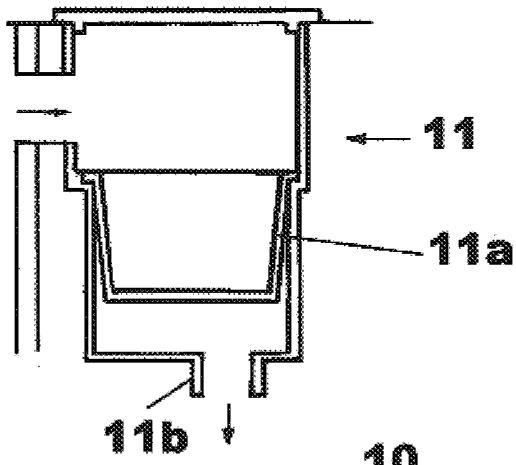
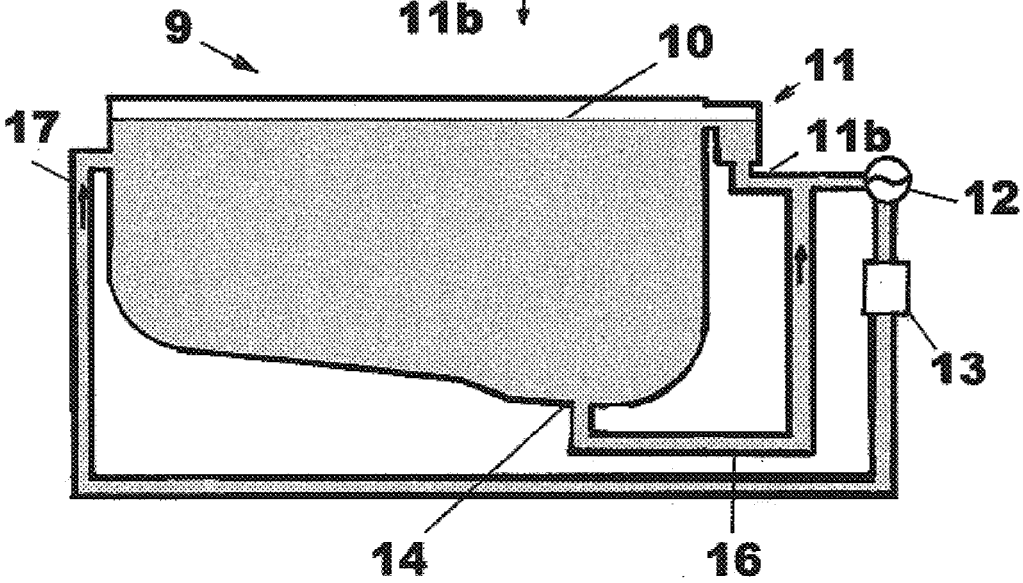
FIG. 2

SCUPPER WITH AUTOMATIC SHUTOFF VALVE

This invention relates to valves, and in particular to an automatic shutoff valve for use in a swimming pool skimmer, where it is important to prevent the suction of air as a result of a low liquid level.

The instant invention utilizes the principle of buoyancy. It employs the use of a float that has sufficient buoyancy in liquid to resist the downward forces created when significant down flow is present, but cannot sustain buoyancy when immersed in a gas. In applications such as skimmer drains for swimming pools and other applications where liquid flows to the suction inlet of a liquid lubricated pump, considerable damage can result to the pump should the pump lose its prime because the flow of liquid to the pump is replaced by a flow of air or other gas. There are numerous occasions such as during periods when pool owners are on a lengthy vacation, that proper pool maintenance is not performed. During those times the summer heat frequently causes a very significant loss of water through evaporation. A leak in the pool structure, or its circulating system, can also cause a loss of water. When the water level drops below the lowest level of the skimmer opening, the residual water in the skimmer body is quickly sucked out by the pump; the pump loses its prime and becomes air bound. This causes the seals of the pump to overheat and eventually results in serious damage or even destruction of the pump. Conversely, when excessive rains occur, it is necessary to pump out the excessive water so that proper skimming of the surface can be performed by the skimmer assembly. Usually the pumping down period is quite lengthy, with only occasional checks being made on the water level. Too often an excessive amount of water is accidentally withdrawn. Unless immediately corrected, this results in the same disastrous results as previously cited. A need exists for a safety check valve that can easily be inserted into an existing skimmer suction outlet that will protect the circulating pump from damaging situations such as those previously mentioned.

The design of a typical swimming pool, skimmer assembly, and circulating system is depicted in prior art FIG. 1 and FIG. 2. Pool 9 is filled with water 10 and communicates with pump 12 through skimmer assembly 11, comprising a basket strainer 11*a* and an unprotected skimmer outlet pipe 11*b*. A second means of communication between water 10 and pump 12 is through main drain 14, main drain outlet pipe 16 connecting with skimmer outlet pipe 11*b* and then to pump 12. The discharge of pump 12 typically flows through filter 13 and is returned to pool 9 through pool inflow pipe 17. When pump 12 is not circulating water through the system, the water levels in pool 9 and skimmer assembly 11 are equalized by gravity flow through the circulating system.

DESCRIPTION OF RELATED ART

The use of check valves to stop the flow of liquids is well known. U.S. Pat. No. 999,619 to J. M. Young, and U.S. Pat. No. 1,538,656 to G. E. Richardson, both describe ball check valves that are designed to operate in the normally closed position, and must be opened manually by means of a ball-lifting device, so that temporary flow is permitted. They then re-close and remain closed when water is present above the valve seat. U.S. Pat. No. 4,240,167 to Elbert G. Gilliland describes a flapper type check valve that also is designed to operate in the normally closed position, and must be opened manually by a lifting device, to permit temporary flow. It then re-closes and remains closed when water is present above the valve seat.

U.S. Pat. No. 4,700,741 to Murphy provides a spring-loaded ball check valve that operates in the open position when there is flow through the valve acting against the spring-loaded ball, but closes when flow ceases or attempts to change direction. U.S. Pat. No 4,687,023 to Harbison et al. describes a freely reciprocating ball check valve that is not spring loaded but requires a reversal of the direction of flow to move the ball to the sealing seat. The ball check is not buoyant, and cannot differentiate between liquid and gas.

BRIEF SUMMARY OF THE INVENTION

The instant invention operates contrary to the typical prior art check valves, in that it is designed to operate in the normally open position when immersed in liquid. It also has the ability to discern the difference between the flow of liquid versus the flow of gases. The float is buoyant in a liquid but is not buoyant in a gas. It therefore has the ability to remain in the closed position until a liquid level above and below the valve is restored. The design of the instant invention does not require the use of a guide rod(s) that would project above the top of the retainer. Such protrusions would seriously limit, or prevent, the valve from fitting within the confines of most intended applications, where a strainer basket is located a short distance above the suction outlet. The float of the preferred embodiment is constructed of celluloid or similar plastic and of the same dimensions typical of ping-pong balls. It can in fact be a ping-pong ball. Its thin wall, high strength, and light weight design provide superior buoyancy and resistance to deformation. The superior buoyancy of the float create its ability to release itself from the valve seat, unless a significant negative pressure exists below the seated float as would be created by a suction pump. The design therefore does not require the use of any float lifting devices as commonly required in toilet tank type check valve assemblies. The instant invention does not utilize a spring and does not require a change of direction to the flow through the valve to cause it to close.

It is the objective of the present invention to provide an automatic shutoff valve which is self contained, simple, economical and has been designed to fit the common configurations of swimming pool skimmer drain assemblies with little or no modification. The automatic shutoff valve closes safely without the need to stop the circulating pump, which in typical installations, is also connected to the bottom drain of the pool. The bottom drain portion of the circulating system will continue to supply adequate water to maintain normal operation of the pump without damaging it. An advantage of the present invention is its ability to automatically restore the system to normal operation unattended, in the event normal rainfall restores the water level in the pool to a safe operating level, or if water is added by an attendant. Since pool circulating pumps are normally programmed to operate for less than twenty-four hours per day, the normal temporary shut down will restore the valve to its normal open position if sufficient rainfall has occurred, or if water has been added by a refill device. When water has been added to the pool manually, the attendant need only stop the pump momentarily to release the float from the outlet of the valve and immediately restore normal operation.

BRIEF DESCRIPTION OF THE SEVERAL VIEWS OF THE DRAWINGS

The invention will be more clearly understood and objects other than those set forth above will become apparent when consideration is given to the following detailed description thereof. Such description makes reference to the accompanying drawings. Six sheets of drawings are provided. Sheet one contains FIG. 1 and FIG. 2. Sheet two contains FIG. 3. Sheet three contains FIG. 4 and FIG. 5. Sheet four contains FIG. 6. Sheet five contains FIG. 7. Sheet six contains FIG. 8 and FIG. 9.

FIG. 1 is a cross-sectional view of a typical prior art design for a swimming pool skimmer assembly.

FIG. 2 is a cross-sectional view of a typical prior art swimming pool water circulating system.

DETAILED DESCRIPTION OF THE INVENTION

Figure 3:
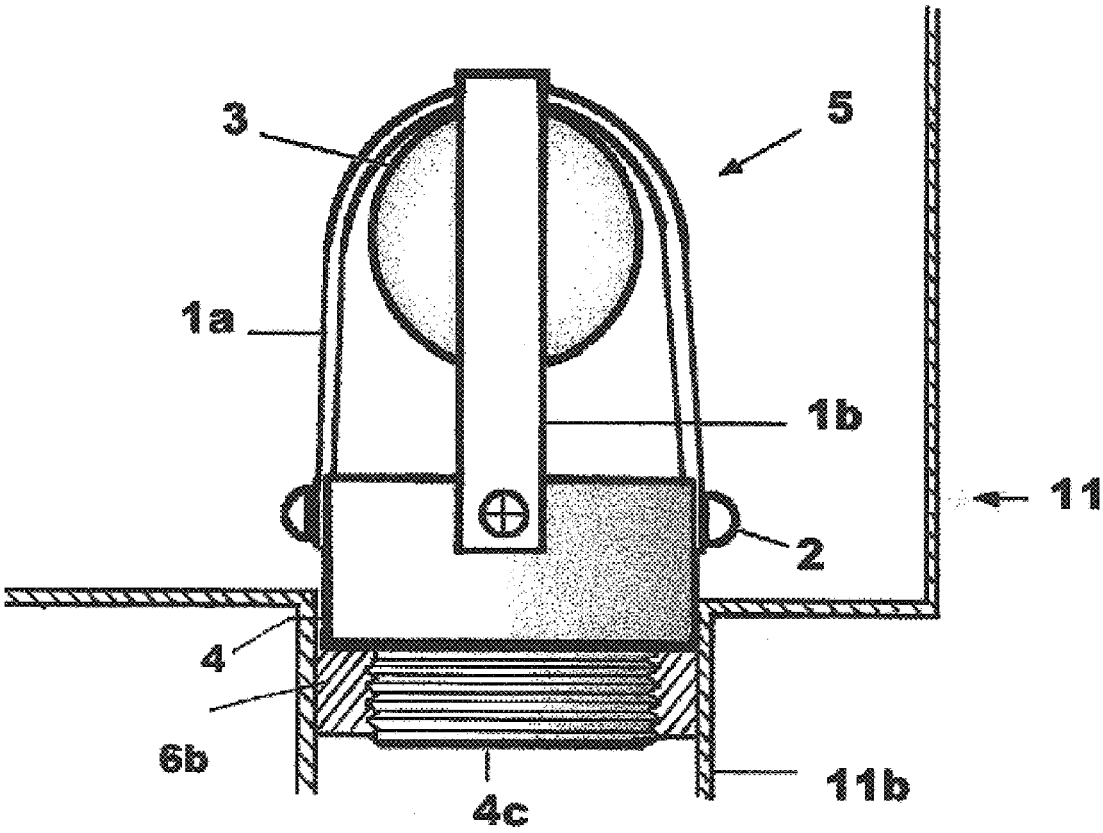
FIG. 3 is a side view of the preferred embodiment automatic shutoff valve, with the float in the open position., as it would be positioned in a typical skimmer assembly.
Figure 4:
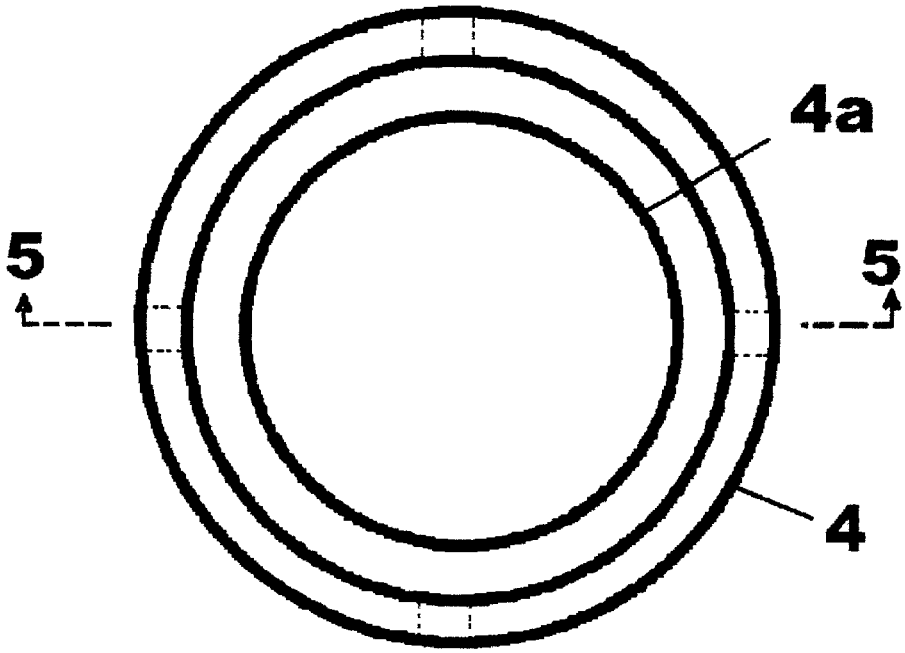
FIG. 4 is a top view of the valve body.
Figure 5:
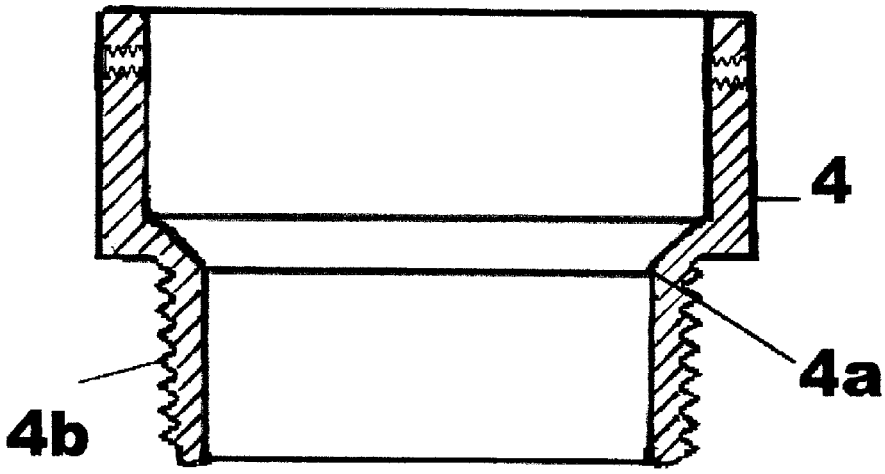
FIG. 5 is a cross-sectional view of the valve body.
Figure 6:
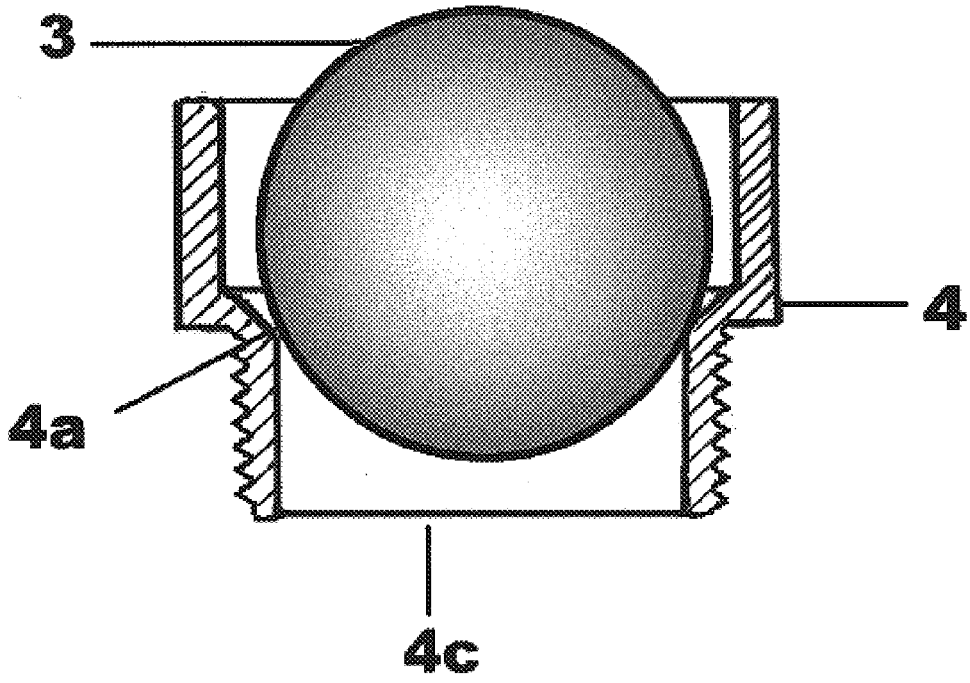
FIG. 6 is a cross-sectional view of the valve body with the float in the closed position.

The instant invention is designed to be easily installed and removed by hand. This is an important requirement when pool-vacuuming equipment is to be inserted in the skimmer outlet pipe for routine pool maintenance. The instant invention is likewise designed for easy maintenance of its valve seat and float. Referring to FIG. 3, we observe a side view of automatic shutoff valve 5 located in a skimmer outlet pipe 11*b*, of a typical prior art skimmer assembly 11. Retainers 1*a* and 1*b* are attached to valve body 4 by means of fasteners 2. Float 3 is shown in the valve open position within retainers 1*a* and 1*b*. Although the accompanying figures depict retainers 1*a* and 1*b* attached with threaded fasteners, it is considered within the scope of this invention that any appropriate means be used to attach retainers 1*a* and 1*b* to valve body 4. Valve 5 is secured in outlet passage 4*a* of skimmer assembly 11 by means of resilient body seal 6*b*. FIG. 4 is a top view of valve body 4. FIG. 5 is a cross-sectional view of valve body 4. FIG. 6 is a cross-sectional view of valve body 4 with float 3 seated on valve seat 4*a*, and outflow passage 4*c*. Float 3 has a diameter larger than that of valve seat 4*a*, to sealably seat in valve seat 4*a* when in the closed position.

Alternate Embodiments

Figure 7:
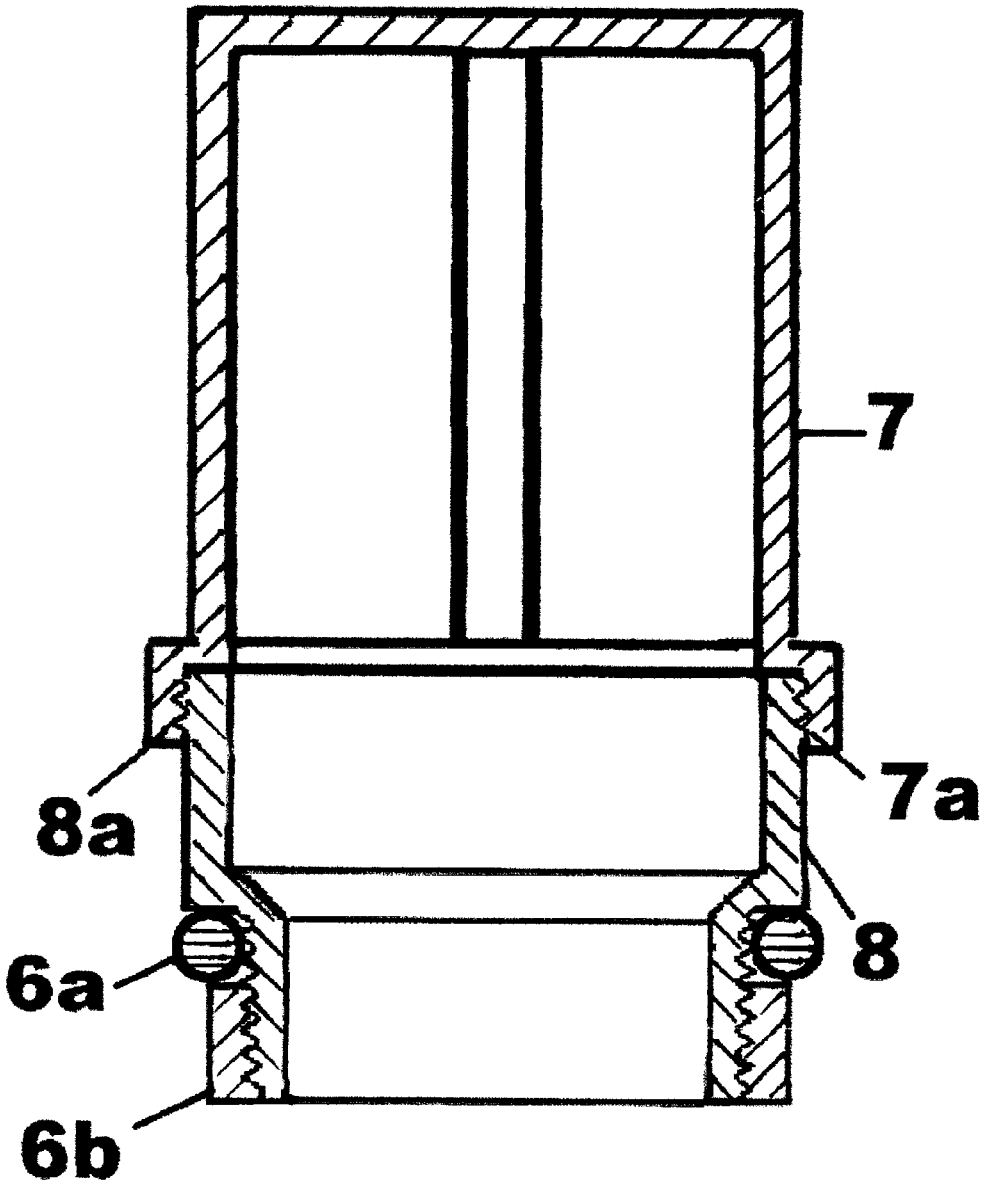
FIG. 7 is a side cross-sectional view of alternate embodiments incorporating the use of a molded retainer with a threaded base and a valve body with a matching threaded top. Also, an "O" ring body seal and an option resilient body seal. The alternate embodiments, of an "O" ring body seal and/or resilient body seal, can also be incorporated into the preferred embodiment valve of FIG. 3.
Figure 8:
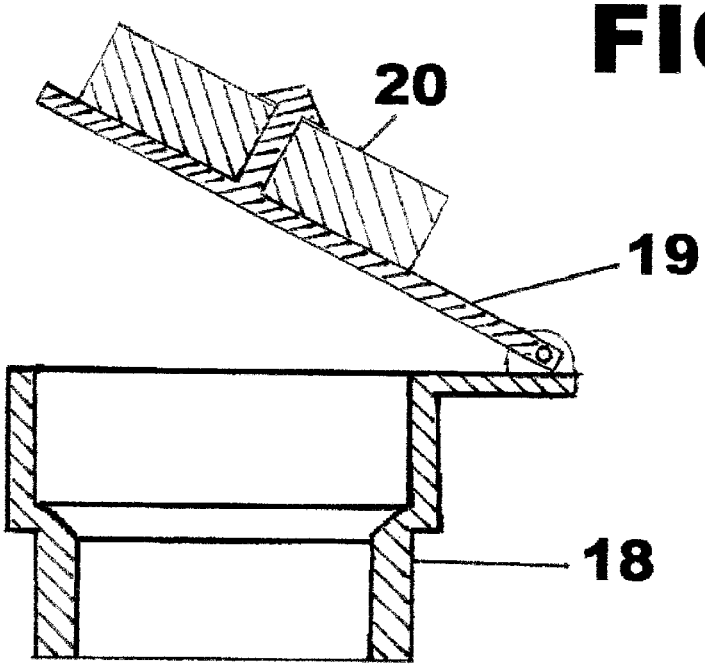
FIG. 8 is a cross-sectional view of alternate embodiment flapper type automatic shutoff valve.
Figure 9:
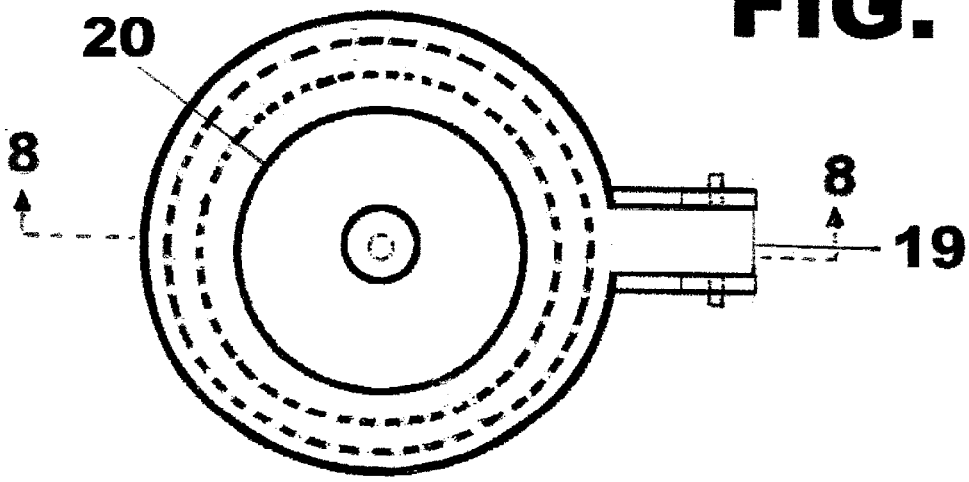
FIG. 9 is a top view of alternate embodiment flapper type automatic shutoff valve.

FIG. 7 is a cross-sectional view of an alternate embodiment incorporating the use of, molded retainer 7, threaded base 7*a*, valve body with threaded top 8, threaded top 8*a*, "O" ring body seal 6*a*, and optional resilient body seal 6*b* can replace or supplement threaded portion of valve body 8, or threaded portion 4*b* of valve 5, as a means of securing the automatic shutoff valve in position, for specific styles of existing outlet openings that are being protected by the use of the invention. The portion of the molded retainer above the threaded base is depicted as cylindrical. It is important to note that the shape may be any shape conducive to minimizing resistance to the fluid flow through it. FIG. 8 is a cross-sectional view of an alternate embodiment incorporating resilient base 18 of molded rubber or resilient plastic, resilient flapper 19 of polypropylene or similar low density plastic, flapper float 20 of buoyant polystyrene or closed cell urethane.

Operation of Preferred Embodiment

The valve float 3 is free floating within the restraints of retainers 1*a* and 1*b* when automatic check valve 5 is immersed in fluid and oriented with the valve body 4 and outflow passage 4*c* in a position below that of float 3. As the fluid level drops, float 3 descends toward valve body 4 and when in close proximity with valve seat 4*a*, is pulled by the fluid flow to a tightly seated position on valve seat 4*a*, preventing flow through outflow passage 4*c*. Float 3 is held tightly onto the valve seat 4*a* by the suction of the circulating pump to which outflow passage 4*c* is connected. When suction is interrupted by stopping the circulating pump, the water levels in the skimmer and pool equalize. This communication allows the automatic shutoff valve 5 to detect the level of water in the skimmer. Float 3 will release from valve seat 4*a* and rise to the liquid level above, or to the limits of travel permitted by retainers 1*a* and 1*b*. If no fluid is present, float 3 remains seated on valve seat 4*a* and is re-drawn tightly into a sealing mode when the pump restarts. If the level of water is sufficient, float 3 in automatic shutoff valve 5 will rise from valve seat 4*a* and restore normal flow through skimmer assembly 11. This communication cycle occurs each time pump 12 is stopped, and continues until the proper water level is restored. The valve therefore does not require the use of any float lifting devices as commonly required in toilet tank type check valve assemblies.

When periodic maintenance of the preferred embodiment valve 5 is required, retainer 1*b* can be pivoted about fasteners 2 to provide easy access to the float and valve seat. Likewise periodic maintenance of alternate embodiment valve FIG. 7 is provided by unscrewing threaded base 7*a* of molded retainer 7, from the threaded top 8*a* of valve body 8. Alternate embodiment valve FIG. 8, when in the open position, provides direct access to outflow passage 4*c* for insertion of a pool vacuuming hose without removing the valve.

Thus the reader will see that the value of the invention provides a simple, highly reliable yet economical device that can be easily installed by almost anyone.

While the above description contains many specificities, these should not be construed as limitations on the scope of the invention, but rather as an exemplification of the embodiments thereof. Many other variations are possible. The essential factors are that the movable portion of the valve be naturally buoyant and the stationary valve body be of sufficient weight and density such that the entire valve assembly as a unit will not float when immersed in liquid. This can be accomplished by the use of high-density materials such as metal polyvinyl chloride (PVC), nylon or rubber for the non-movable parts such as the valve body. It is essential that all the materials utilized have good natural corrosion resistance. All metallic parts utilized should be of metals such as aluminum, stainless steel, brass, bronze or monel. Accordingly, the scope of the invention should be determined not by the embodiment(s) illustrated, but by the appended claims and their legal equivalents.

List of Reference Numerals

1*a* retainer (inner)
1*b* retainer (outer)
2 fastener
3 float
4 valve body
4*a* valve seat
4*b* threaded portion of the valve body
4*c* outflow passage
5 automatic shut-off valve
6*a* "O" ring body seal
6*b* resilient body seal
7 molded retainer
7*a* threaded base
8 valve body with threaded top
8*a* threaded top
9 typical pool system
10 water
11 skimmer assembly
11*a* basket strainer
11*b* skimmer outlet pipe
12 pump
13 filter
14 main drain
16 main drain outlet pipe
17 pool inflow pipe
18 resilient base
19 resilient flapper
20 flapper float

I claim:

1. An automatic shutoff valve installed at the opening of a skimmer outlet pipe that communicates with a pool circulating pump inlet, said valve comprising:

(a) a float disposed within a retainer and above a valve body attached to said retainer, said valve body containing a valve seat, said float being sized to sealably seat on said valve seat, and is free to move within the retainer, (b) said float is normally in an open position removed from said valve seat;

(c) said float is a resilient material of positive buoyancy in water;

(d) said float comprising a ping-pong ball;

(e) the resilient float creating a water and airtight seal with the valve seat, thereby eliminating the need for an "o" ring or other form of resilient seat material;

(f) the valve being design to be installed and removed from a position above the outlet skimmer pipe without the need for tools;

(g) the valve communicates with the pool's circulation pump inlet when water level in the skimmer outlet pipe is restored, thereby releasing the float from the valve seat without the need for lifting device;

(h) the valve body being substantially cylindrical;

(i) means for securing said shutoff valve to a skimmer outlet pipe.

2. Automatic shutoff valve of claim 1 wherein said means for securement comprises a threaded portion of a valve body.

3. Automatic shutoff valve of claim 1 wherein said means for securement comprises an "o" ring body seal.

4. Automatic shutoff valve of claim 1 wherein said means for securement comprises a resilient body seal.

5. Automatic shutoff valve of claim 1 wherein said retainer further comprises:

(a) a molded plastic body comprising an internal female threaded base;

(b) the valve body having an external male thread;

(c) said plastic retainer secured over the valve body by coupling the male and female threads;

(d) said valve thereby having a totally nonmetallic construction, low material cost, and excellent corrosion resistance.

6. Automatic shutoff valve of claim 5 wherein said means for securement comprises a threaded portion of a valve body.

7. Automatic shutoff valve of claim 5 wherein said means for securement comprises an "o" ring body seal.

8. Automatic shutoff valve of claim 5 wherein said means for securement comprises a resilient body seal.

* * * * *